United States Patent [19]

Magidson et al.

[11] Patent Number: 4,873,972

[45] Date of Patent: Oct. 17, 1989

[54] DISPOSABLE FILTER RESPIRATOR WITH INNER MOLDED FACE FLANGE

[75] Inventors: Mark Magidson, Los Angeles; Otto L. Huber, Beverly Hills, both of Calif.

[73] Assignee: Moldex/Metric Products, Inc., Culver City, Calif.

[21] Appl. No.: 152,365

[22] Filed: Feb. 4, 1988

[51] Int. Cl.[4] ..... A62B 7/00

[52] U.S. Cl. ..... 128/206.12; 128/206.24; 128/206.15

[58] Field of Search ..... 128/206.12, 206.15, 128/206.16, 206.17, 206.19, 206.24, 206.26, 207.11, 207.12, 205.27, 205.29

[56] References Cited

U.S. PATENT DOCUMENTS

| | | | |
|---|---|---|---|
| 2,133,699 | 10/1938 | Heidbrink | 128/206.24 |
| 3,330,273 | 7/1967 | Bennett | 128/206.26 |
| 3,330,274 | 7/1967 | Bennett | 128/206.26 |
| 4,454,881 | 6/1984 | Huber et al. | 128/206.15 |
| 4,630,604 | 12/1986 | Montesi | 128/206.15 |

FOREIGN PATENT DOCUMENTS

| | | | |
|---|---|---|---|
| 614142 | 2/1961 | Canada | 128/206.17 |

*Primary Examiner*—Edgar S. Burr
*Attorney, Agent, or Firm*—Charles H. Schwartz; Ellsworth R. Roston

[57] ABSTRACT

A filter respirator forming a face mask to be worn upon the face of a user including a support layer of flexible material. The support layer is molded to conform to the contours of the face of the user and forms a flexible support layer for filter material. A separate layer of filter material filters out impurities. An exhalation valve extends through the support layer and the filter layer in a central position. The exhalation valve includes an inside surface surrounding the central position. A molded non-porous flexible inner flange forms a flexible half-mask for sealing to the face of the user. The inner flange is attached to the peripheral edges of at least the support layer and extends inward to the central position. The inner flange includes a central opening with a surrounding portion conforming and adjacent to the inside surface of the exhalation valve. This forms an inhalation valve between the inside surface of the exhalation passage and the surrounding portion of the central opening of the inner flange.

27 Claims, 2 Drawing Sheets

DISPOSABLE FILTER RESPIRATOR WITH INNER MOLDED FACE FLANGE

BACKGROUND OF THE INVENTION

1. Field of the Invention The present invention relates to face masks and in particular to a face mask forming a disposable filter respirator with an inner molded face flange and inhalation/exhalation valves.

2. Description of the Prior Art In the prior art, disposable face masks have been constructed, in their simplest form, of a layer of material, such as fiberfill material which layer forms both the filter material itself and the support to position the mask over the nose and mouth of a user. The mask is typically held in position by elastic straps which are attached at the sides of the mask and extend around the back of the head.

Other disposable face masks have been constructed of layers of fiberfill material supporting a separate layer of filter material, such as a layer of filter material supported between two outer layers or by a single layer of fiberfill material Other types of disposable face masks have used other materials to form the support surface, such as the use of an openwork plastic material forming a self-supporting net to hold and support the filter material. These more complicated structures include a self supporting layer to provide for a better fit of the mask against the face of the user when the mask is held in place by the elastic straps.

Two problems which occur with the use of any face mask are: (1) a proper fit of the face mask to the face of the user so as to eliminate as much as possible, any passage of air to the user before it has passed through the filter material and (2) a heat and moisture buildup which can occur within the mask, especially if the user of the mask is engaging in strenuous work. It can be seen that these two problems are somewhat interrelated since it is desirable to provide for a good fit of the mask to the face of the user and the better the fit, the tighter the seal and the more the problem of heat and moisture buildup. This is because if the fit is not proper, then exhaled air, including heat and moisture can leak around the edge of the mask to the exterior. However, an improper fit can be dangerous since if exhaled air can leak out, inhaled air can leak in and as indicated above, all inhaled air should pass through the filter material.

One solution to the problem of heat and moisture buildup within the mask is the use of an exhalation valve located within the mask. For example, reference is made to prior U.S. Pat. No. 4,454,881 having the same inventors as the present application and with this patent disclosing a disposable filter mask having an exhalation valve. In addition, this patent discloses the use of a sealing bead located around the peripheral edge of the mask to provide an edge seal between the mask and the face of the user and additionally including membrane portions extending from the bead member to enhance the fit of the mask at least in the areas of the sides of the nose and the upper cheekbone of the user.

Although the mask shown in U.S. Pat. No. 4,454,881 is an improvement over prior disposable face masks, it still has some deficiencies. Specifically, it is desirable to provide for an ever better fit of the mask to the face of the user and to provide for a check of this fit and further to channel inhaled air more directly to the nose area of the user and to direct the exhaled air out of the mask to more completely eliminate the problem of heat and moisture buildup.

There have been other prior art attempts to solve the above described problems. For example, reference is made to U.S. Pat. No. 4,630,604 listing Edward N. Montesi as the inventor which patent discloses an inhalation/exhalation valve assembly for a disposable filter respirator. The Montesi patent describes a respirator having a disposable filter and includes a valve having a central aperture providing concentric inhalation and exhalation valves. The filter structure of the Montesi patent is generally formed from relatively rigid molded plastic members supporting a filter material and with an inner 0 rubberlike face piece of the type well known in the art providing for the sealing of the mask to the face of the user. The Montesi respirator, although providing for a good seal of the mask to the face of the user and also providing for the substantial elimination of heat and moisture buildup, suffers from a number of deficiencies. First, the mask is relatively expensive to make since it is formed from relatively rigid molded plastic members which are expensive to manufacture and difficult to assemble. Second, the mask is somewhat cumbersome because of its large size and rigid construction.

SUMMARY OF THE INVENTION

The present invention provides for a disposable filter respirator with an inner molded face flange which accomplishes substantially all of the results as the Montesi patent, but is simpler in construction, less expensive in cost, more efficient in use, lighter in weight and much more comfortable for the user and thereby much more likely to be worn.

The present invention is directed to a disposable filter respirator which includes an inner molded flexible face flange and with a portion of the flange forming in combination with an other structure an inhalation passage which in one embodiment of the invention forms a valve. The mask also includes an exhalation valve. The structure of the inhalation passage and exhalation valve are interrelated with each other to minimize the cost of these structures. All of the inhaled air passes through the filter material and through the inhalation passage at a central position to provide for a cooling effect as air is inhaled. All of the exhaled air is directed at the central position through the exhalation valve so that substantially all of the exhaled air passes easily out of the mask to avoid heat and moisture build up.

In addition to the above, the inner face flange provides for the proper fit of the mask to the face of the user and with the flange accommodating to the contours of different sizes and shapes of the face of different users so that the same basic mask may be worn by a large percentage of potential users of the mask. The inner flange is formed to have a structure similar to that of a rubber half mask except that the inner flange is attached to the filter mask at the periphery of the mask and extends inward to a central position and is unattached at this central position. At the center of the mask, an exhalation valve is fitted and with the unattached central portion of the inner flange concentric around the exhalation valve and forming in combination with a portion of the exhalation valve an inhalation passage which in one embodiment of the invention forms a valve.

The fit or seal of the mask on the face of the user may be checked by placing the palm of the hand over an exhaust port for the exhalation valve and pressing lightly to block exhalation. The user then exhales to form a slight positive pressure within the mask. If the mask is properly sealed, then no air will leak around the periphery of the mask while the exhaust port of the exhalation valve is blocked. If air does leak, then the mask can be readjusted to properly fit the mask in position.

The disposable filter respirator of the present invention may include filter and supporting layers similar to prior art structures. For example, the supporting layer may be formed from openwork plastic resembling a net in a similar manner to prior art filter masks and the filter material itself may be formed from any of the known types of filter material to provide for filtering of impurities in the air. This filter material may take a wide variety of forms and the present invention is not limited to any particular type of filter material. In general, however, the type of filter material that would be used would be an efficient filter material that would tend to somewhat restrict inhalation and exhalation and thereby the use of the inhalation/exhalation valves of the present invention combined with the inner flange is particularly desirable.

BRIEF DESCRIPTION OF THE DRAWINGS

A clearer understanding of the present invention will be had with reference to the following description and drawings wherein.

DETAILED DESCRIPTION OF THE PREFERRED EMBODIMENT

Figure 1:
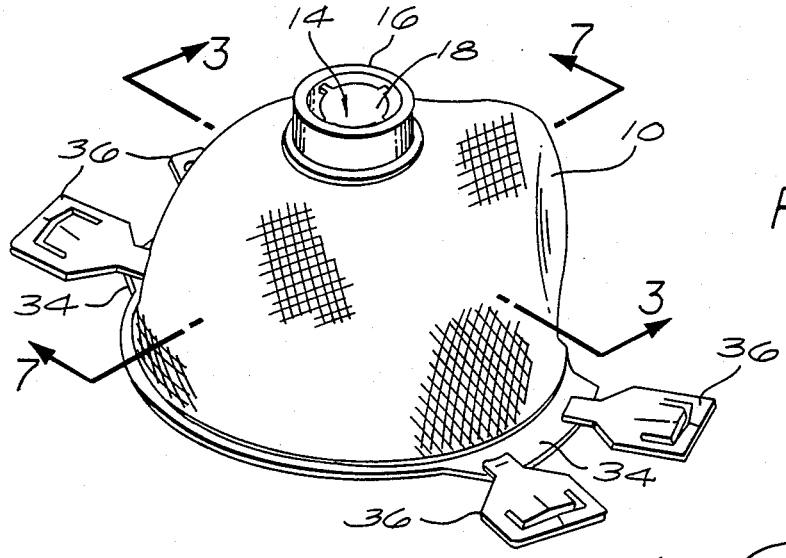
FIG. 1 is a front perspective view of a mask forming a disposable filter respirator of the present invention.
Figure 2:
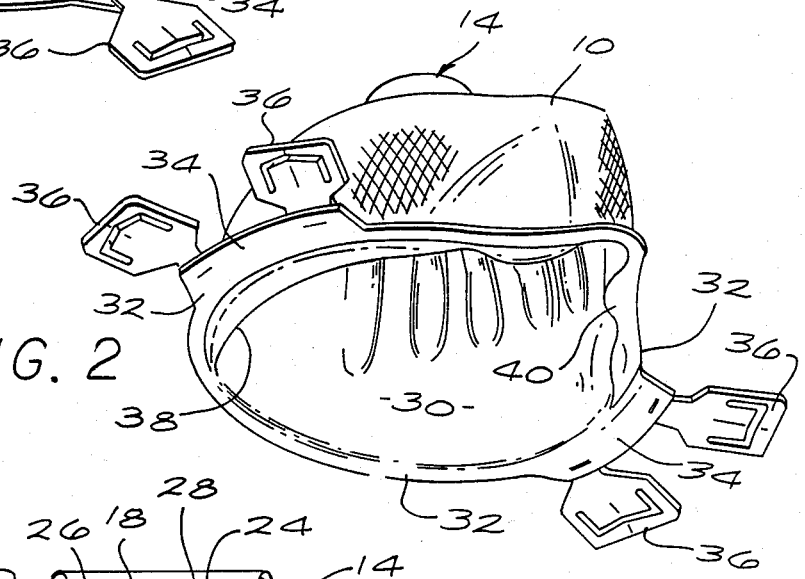
FIG. 2 is a back perspective view looking into the inside of the mask of the present invention.
Figure 3:
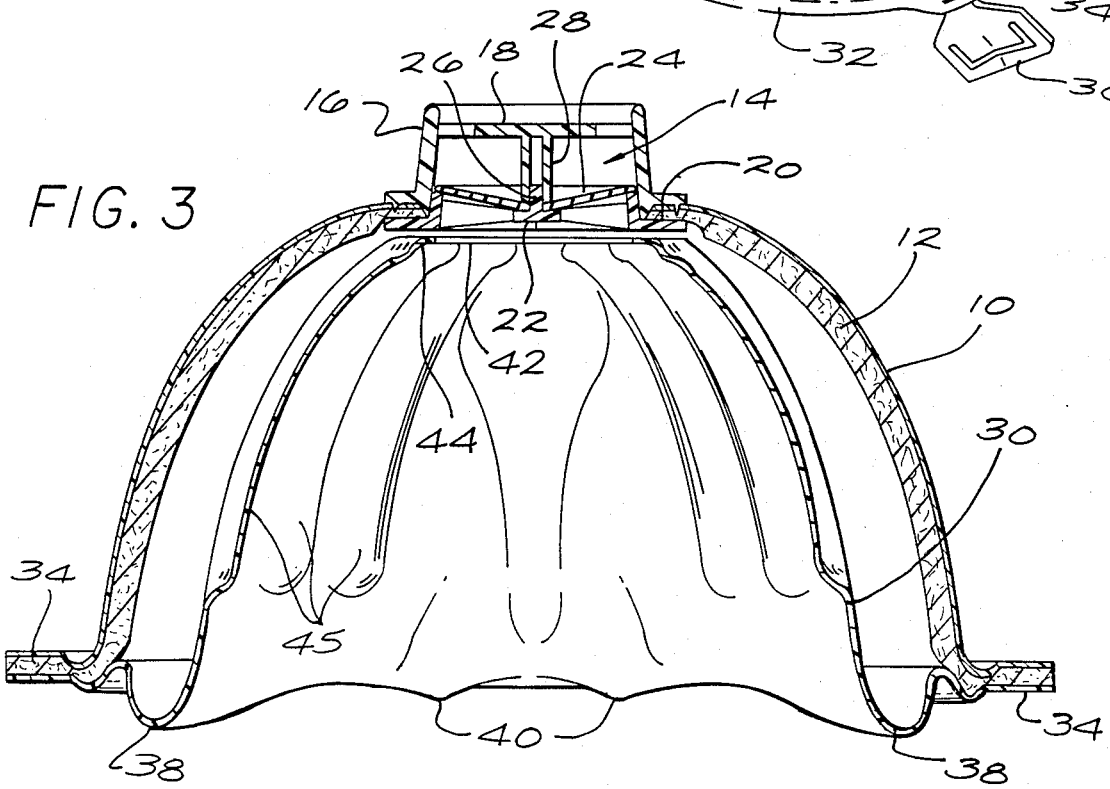
FIG. 3 is a cross sectional view of a first embodiment of the mask of the present invention taken along lines 3—3 of FIG. 1.

As shown in FIGS. 1, 2 and 3, a filter mask is generally formed including an outer layer 10 of resilient material forming a supporting layer. Specifically, this outer layer 10 may be formed of an openwork plastic material to form a support for the filter respirator and specifically to support the filter material. The outer layer 10 generally retains its shape while at the same time allowing for the free passage of inhaled air through the filter material. As shown in FIG. 3, filter material 12 is supported by the outer supporting layer 10. The filter material 12 is shown to extend completely out to the periphery of the support layer 10 but it is to be appreciated that the filter material may be terminated short of the periphery as long as no inhaled air can bypass the filter material.

The filter material may be formed of any known type of filter material so as to provide for filtering of particulate elements in the air. For example, the following types of filter material have been used to provide for filtering, but it is to be appreciated that other filter material may be used: activated charcoal treated sheets or sheets formed by charcoal articles, fiberglass material, fine denier, non-woven polyethylene or polypropylene materials which may be or may not be electrostatically treated, natural material such as wool. The filter layer 12 may be formed from any one of these materials or any other known filter material.

Supported at a center position of the mask and extending from the interior to the exterior is an exhalation valve 14. The exhalation valve 14 may be of a known type but preferably is similar in structure to an exhalation valve shown in co-pending application Ser. No. 933,879 filed Nov. 24, 1986 and assigned to the same assignee as the instant application. The exhalation valve of the present application is somewhat different than the co-pending application in that it includes an outer member 16 having an L-shaped cross section which extends forwardly to form an exhaust channel or port and with the outer member 16 also supporting an internal spider member 18. The exhalation valve may, therefore, be closed off by placing the palm of the hand at the outside of the valve to cover the lip of the outer member 16 to thereby seal off the exhaust channel or port.

The exhalation valve is essentially formed of three members including the outer member 16 with the spider member 18 suspended within, an inner member 20 also having a L-shaped cross section which supports an inner spider member 22 and a flexible membrane 24. The inner spider member includes a pin portion 26 which extends through an opening in the membrane 24 and is in turn received within a tubular portion 28 extending from the outer spider member 18. The flexible membrane 24 is, therefore, captured between the pin member 26 and the tubular member 24 and as described in the co-pending application this provides for an efficient and accurate positioning of the flexible membrane 24. The outer perimeter of the flexible membrane 24 rests on a portion of the inner member 20. The inner member 20 nests within the outer member 16 and captures the support layer 10 and filter layer 12 therebetween. In this way, the exhalation valve 14 is sealed in a central position in the mask. The specific operation of the exhalation valve 14 will be described with reference to the operation of the entire valve and passage structure at a later portion of this specification.

As shown in FIGS. 2 and 3, a flexible inner flange 30 is supported at the periphery of the disposable filter and extends inward to form essentially a flexible non-porous face mask. This inner flange 30 may be made of any appropriate plastic or rubber like material and includes an outer peripheral portion 32 which extends completely around the perimeter of the disposable filter and is sealed to the filter material 12 and outer supporting layer 10 at the perimeter to form an integral structure. The inner flange may be sealed directly to the outer layer 10 if the filter material 12 does not extend out to the periphery of the outer layer.

Figure 8:
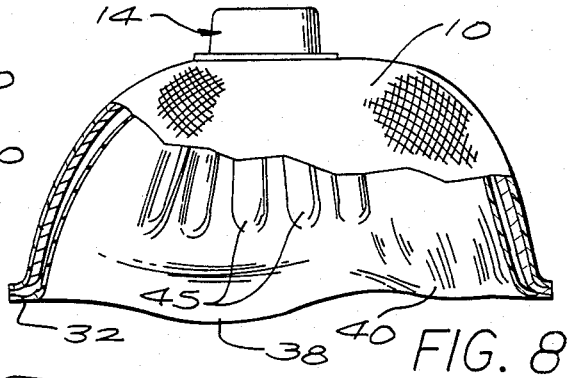
FIG. 8 is a cross sectional view taken along lines 7—7 of FIG. 1 and showing, in particular, the contours of the inner flange member.

As can be seen in FIGS. 1 and 2, integral flange portions 34 formed by all three layers 10, 12 and 30 of the mask may extend from both sides of the mask and may be used to support strap holders 36. It is to be appreciated that, as an example, only the outer layer may extend outward to form the flange portions 34. The peripheral portion 32 of the flange 30 forms a flat profile in a plane around the circumference of the flange. This can be seen clearly in FIG. 2. Extending into the center of the mask, the inner flange 30 includes portions 38 and 40 which puff out to enhance the sealing of the inner flange to the face of the user while other portions of the inner flange round off from the flat periphery 32 into the center of the flange. This configuration may be clearly seen in FIG. 8 which shows in cross section the outside profile of the inner flange 30.

Figure 7:
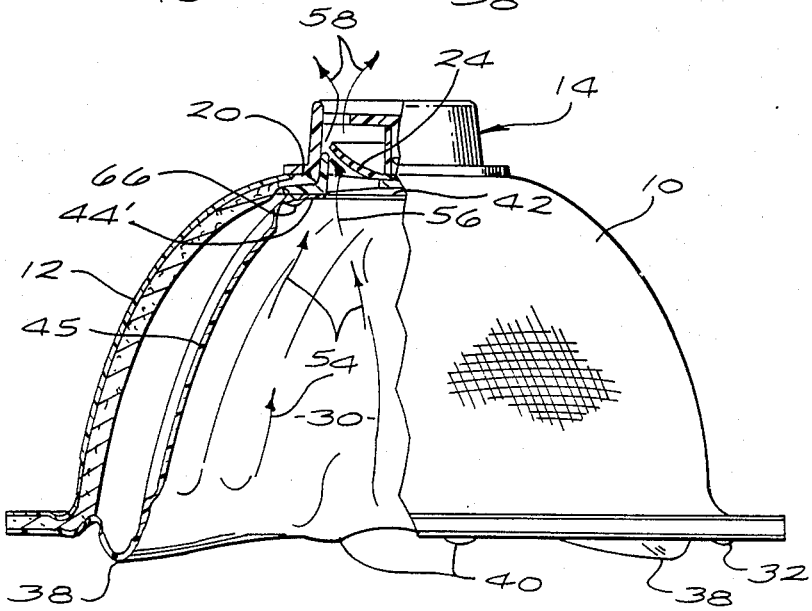
FIG. 7 is a partial cross sectional view illustrating the operation of a second embodiment of the mask during exhalation.

The particular configuration of the inner flange 30 allows for a superior fit of the mask to the face since it provides for an accommodation to the contours of the face. Specifically, face masks generally are made with a configuration wherein the nose bridge and chin portions tend to be relieved relative to the side portions of the mask. However, with the inner flange 30 of the present invention, the outer peripheral portion is flat and in a single plane for ease of manufacture. In order to provide for the relieved profile and produce a better fit to the face of the user, the puffed out portions 38 extend outward in the areas of the cheeks as shown in FIGS. 2 and 7 and the portions 40 extend inward in the areas at the sides of the nose so that the sealing perimeter does conform to the desired shape for sealing to the face of the user. The puffed out portions effectively provide for a recess in the nose bridge and chin areas.

The outer perimeter 32 is flat to allow for an easier and more efficient attachment of the inner flange 30 to the layers of filter and supporting material 10 and 12. This attachment is normally accomplished with a welding, such as an ultrasonic welding and it is much simpler to provide for this welding in a flat configuration as opposed to trying to provide for the welding to follow an irregular configuration as shown by the portions 38 and 40.

Figure 4:
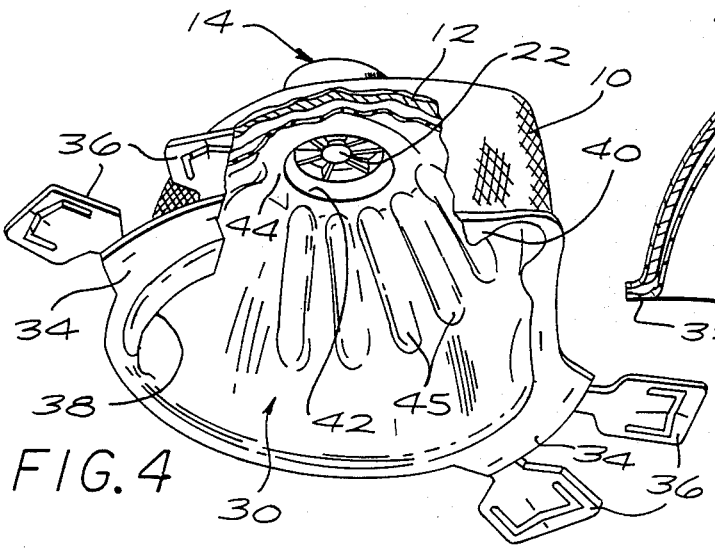
FIG. 4 is a back perspective view partially broken away showing the inner center portion of the inner flange of the first embodiment of the mask of the present invention.

The inner portion of the inner flange 30 terminates with a circular opening 42. This can be seen clearly in FIG. 4 and can also be seen in the various cross sectional views. In general, in a first embodiment of the invention a flattened portion 44 of the inner flange 30 is provided to surround the circular opening 42. As can be seen in FIG. 3, the flattened portion 44 is immediately adjacent a flat inner surface of the inner member 20 and the combination of the flattened portion 44 with the inner surface of the inner member 20 forms an inhalation passage.

The inner flange 30 may also include integrally molded elongated air channels 45 which extend away from the filter material 10. The air channels 45 insure that inhaled air is channelled to the circular opening 42 even if the filter material 10 collapses since the channels 45 provide for air passages.

Figure 6:
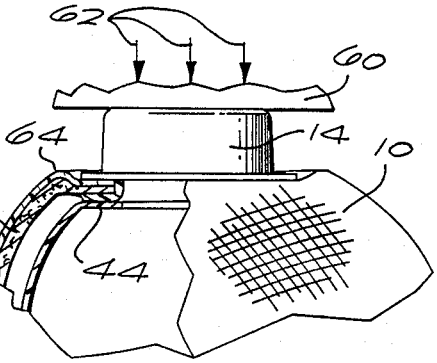
FIG. 6 is a fragmentary partial cross sectional view illustrating a seal check for the mask of the present invention.
Figure 5:
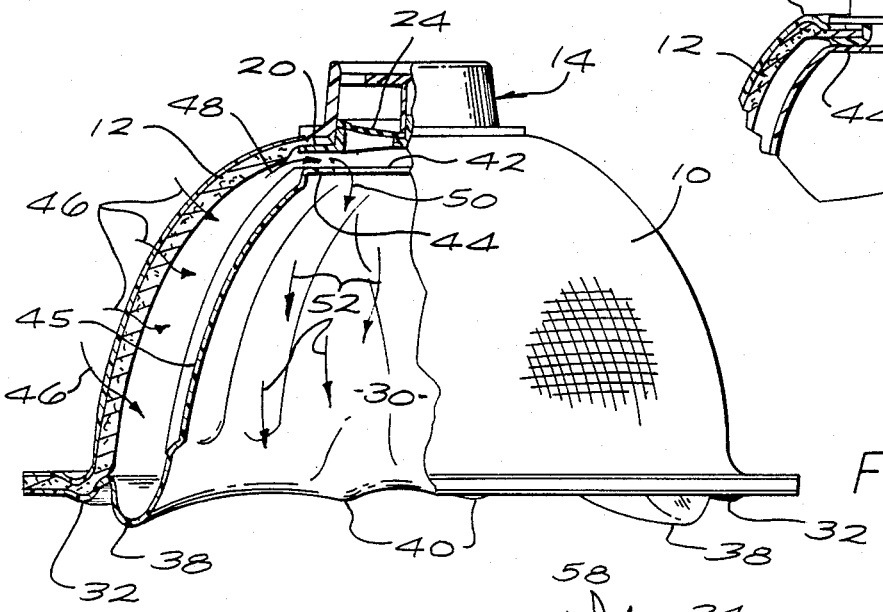
FIG. 5 is a partial cross sectional view illustrating the operation of the first embodiment of the mask during inhalation.

FIGS. 5 and 6 illustrate the operation of the first embodiment of the disposable filter respirator of the present invention. Specifically, as shown in FIG. 5, when air is inhaled the air passes through the openings in the outer supporting layer 10 and through the filter material as shown by the arrows 46. This occurs throughout the entire surface of the mask wherever air can enter. Because the inner flange 30 is non-porous the filtered air is channeled down to the center of the mask as shown by the arrow 48 and passes through the inhalation passage formed by the flattened portion 44 and the inner surface of the inner member 20. The filtered air enters the interior of the mask, as shown by the arrow 50, and through the circular opening 42 of the inner flange 30.

As shown in FIG. 5 as compared with FIG. 3 the inner flange 30 may be constructed to be flexible enough so that the flattened section 44 may move further away from the inner member 20 so as to provide for an efficient flow of filtered air into the center of the mask as shown by the arrow 50. When the filtered air enters the center of the mask it may, therefore, be directed to the nose and mouth of the user of the mask as shown by the arrows 52. The inhalation, therefore, is provided through the central opening 42 which tends to produce a cooling effect since the air is concentrated through the center opening and is not distributed over a wide interior portion of the mask. Also, the air is concentrated through the center of the mask and aimed directly at the nose and mouth to provide for a more efficient inhalation.

The small movement of the inner flange 30 to allow for the free passage of the air through the opening 42 does not in any way disturb the sealing of the mask to the face of the user since the peripheral sealing portions 38 and 40 are compressed against the face of the user by resilient straps (not shown) which are attached to the strap holders 36. The peripheral sealing portions 38 and 40 are specifically designed to have a flexible cushioning contour to seal over a broad portion of the face and to eliminate leakage of the mask even with the minor flexing of inner portions of the flange 30. As can also be seen in FIG. 5 during inhalation, the flexible membrane 24 is pulled tight against a portion of the member 20 to thereby prevent the inhalation of any air through the exhalation valve 14. During exhalation, exhaled air is directed by the inner flange 30 to the exhalation valve 14. The membrane 24 opens to exhaust the exhaled air.

FIG. 6 illustrates the operation of the disposable filter respirator of the present invention during a seal check. Specifically, the user may place the palm of the hand, as represented by portion 60 against the exhalation valve 14 and lightly push, as shown by arrows 62 to slightly deform the mask as shown by deformed portion 64 to seal the flattened portion 44 against the member 20. As will be later explained, this provides a check of the fit of the mask to the face of the user.

FIG. 7 illustrates the operation of a second embodiment of the mask of the present invention during exhalation. The second embodiment includes a flattened portion 44' which extends from a ring portion 66 to increase the flexibility of the flattened portion 44' relative to the inner flange 30. If necessary, additional ring portion 66 may be used to further increase the flexibility, or portions may be thinned to increase the flexibility or the flattened portion 44' may be a separate flexible membrane if desired.

As shown in FIG. 7, during exhalation of air as illustrated by the arrows 54, the exhaled air is directed again to the central opening 42 since the inner flange 30 is non-porous. During exhalation the pressure of the air, as shown by the arrows 54, pushes the flattened portion 44' against the member 20 to thereby seal the flattened portion 44' of the inner flange 30 against the inner surface of the member 20. This completely prevents air from passing into the chamber between the inner flange 30 and the filter material 12. All of the air is therefore directed outward, as shown by the arrow 56, to pass through the exhalation valve and exit the respirator as shown by the arrows 58. It will be appreciated that with the first embodiment of the invention, some air during exhalation can pass into the chamber between the inner flange 30 and the filter material 12 but this will be minimized due to the use of the inner flange 30 directing the exhaled air to the exhalation valve 14.

During the exhalation period, the pressure of the air flexes the flexible membrane 24 outward to create an opening between the flexible membrane 24 and the member 20 to allow for the free exit of the air. Again, the air is directed to a central opening to exhaust the air easily and relatively completely from the interior of the respirator. This helps to eliminate a buildup of heat and moisture within the mask and also prevents this heated and moisture laden air from interacting with the filter material 12. This increases the life of the filter material and allows for the disposable respirator to be worn for a longer period of time without reducing the effectiveness of the filter material. It should be appreciated that the filtering efficiency of the filter material can be degraded if it interacts with exhaled air and it is, therefore, preferable to have the filter material only interact with inhaled air.

It can be seen, therefore, that the present invention provides for a disposable filter respirator with an inner molded face flange which is simple in construction, inexpensive in cost and efficient in operation. The inner flange 30 may be first molded to have the desired face conforming configuration and yet with a flat outer peripheral portion 32. Similarly, the outer support layer 12 may be also molded to have the desired face conforming configuration and also with a flat outer periphery. The filter material 12 may also be formed to fit within the outer supporting layer and similarly have a flat outer periphery. Alternatively, the filter material may not extend completely to the periphery of the mask. It is also to be appreciated, that if the filter material has enough structural integrity to be self supporting, the outer layer 10 may be eliminated and the mask formed only from filter material 12 and the inner flange 30.

The exhalation valve 14 may be fitted into position through a central opening in the outer supporting layer 10 and filter material 12. The valve 14 is actually formed to have an inner surface which forms part of an inhalation valve. The inner flange 30 may be welded in position at the flat periphery and yet have peripheral sealing portions extending outward and inward to produce the maximum efficiency for sealing the respirator to the face and with the inner flange having a central opening and a flattened portion with serves, in cooperation with a surface of the exhalation valve, to form an inhalation passage or an inhalation valve. The structure, therefore, is simple and inexpensive and yet provides for the efficient inhalation and exhalation to reduce heat and moisture build up and eliminate this heat and moisture buildup from interacting with the filter material.

The fitting of the mask to the face of the user may be easily accomplished with the respirator of the present invention. Specifically, once the mask is positioned on the face, the user merely places the palm of the hand against the exhalation valve and gently presses to close off the exhalation valve. The inhalation passage or valve is also closed off as shown in FIGS. 6 and 7. The user now can exhale gently to determine whether any air is escaping around the periphery of the respirator. If air does escape, then the user can adjust the respirator so that the flange is sealed properly to the face so no air can escape. The check of the fit of the mask to the face of the user can, therefore, be accomplished very quickly and actually can be periodically checked during the day to insure that the mask is still fitting properly.

The present invention, therefore, provides for a simple, yet reliable disposable filter respirator which produces substantially all of the advantages of prior art respirators without being cumbersome in construction and expensive in cost. Moreover, the respirator of the present invention is very comfortable to wear and yet provides for an efficient and reliable seal or fit of the respirator which can be periodically checked. The respirator includes both an inhalation passage or valve and exhalation valve which is simple in construction yet reliable in operation. All of the above is accomplished in a relatively low cost disposable respirator without sacrificing reliability and efficiency of filtering.

Although the invention has been described with reference to a particular embodiment, it is to be appreciated that various adaptations and modifications may be made and the invention is only to be limited by the appended claims.

We claim:

1. A filter respirator forming a face mask to be worn upon the face of a user for providing filtering of impurities in the air, including, a support layer of flexible material including outer peripheral edges generally conforming to the contours of the face of the user and forming a flexible support layer of filter material and constructed to allow air inhaled by the user to flow through the support layer, a separate layer of filter material supported by the support layer of flexible material and having properties of filtering impurities in the air inhaled by the user, an exhalation valve extending through the support layer and the filter layer in a central position for exhausting air exhaled by the user and including an inside surface within the central position, and a non-porous flexible inner flange forming a flexible half-mask conforming to the contours of the face of the user, means providing for the passage of the inhaled air through the support layer and the layer of filter material and the deflection of such inhaled air by the inner flange, said means comprising said inner flange being sealingly attached to the outer peripheral edges of at least the support layer, the inner flange extending inwardly to the central position to direct the inhaled air, after deflection, to the central position and including a central opening with a surrounding portion conforming and contiguous to the inside surface of the exhalation valve, the surrounding portion of the inner flange being movable away from the inside surface of the exhalation valve, upon the inhalation of air by the user, and thereby forming an inhalation passage between the inside surface of the exhalation valve and the surrounding portion of the central opening of the inner flange to permit the passage of inhaled air to the user.

2. The filter respirator of claim 1 wherein the inside surface of the exhalation valve is substantially flat and the surrounding portion of the inner flange is substantially flat.

3. The filter respirator of claim 2 additionally including a ring portion in the surrounding portion of the inner flange to enhance the flexibility of the surrounding portion.

4. The filter respirator of claim 1 wherein the support layer is formed of an open work plastic defining a net.

5. The filter respirator of claim 1 wherein the support layer includes integral outwardly extending flanges forming support surfaces for straps.

6. The filter respirator of claim 1 wherein means are included in the inner flange for conforming the inner flange to the contour of the face of the user, and means are included in the inner flange for facilitating the attachment of the inner flange to the support layer at the outer peripheral edges of the support layer.

7. The filter respirator of claim 1 wherein the exhalation valve includes an outer wall member forming an outside channel for the exhaled air so that the channel can be covered to block the flow of exhaled air to thereby check the seal of the inner flange to the face of the user.

8. The filter respirator of claim 7 wherein the inside surface of the exhalation valve is substantially flat and the surrounding portion of the central opening of the inner flange is also flattened.

9. The filter respirator of claim 1 wherein the inner flange includes puffed out portions to enhance the sealing of the inner flange to faces of users with different contours.

10. The filter respirator of claim 9 wherein the puffed out portions are at least in the areas corresponding to the sides of the nose.

11. The filter respirator of claim 9 wherein the puffed out portions are at least in the areas corresponding to the cheeks.

12. The filter respirator of claim 11 wherein the puffed out portions in the areas corresponding to the cheeks extend outwardly to form a sealing periphery for the inner flange and the inner flange is recessed in at least the nose bridge areas.

13. The filter respirator of claim 1 wherein at least the support layer and the inner flange include an outer periphery with a flat profile and wherein the inner flange includes puffed out portions in the areas corresponding to the cheeks to extend outwardly to form a sealing periphery for the inner flange and the inner flange is recessed in at least the nose bridge areas.

14. The filter respirator of claim 1 additionally including a plurality of integrally molded elongated air channels which are formed in the inner flange and which extend toward the central position and away from the filter material.

15. A filter respirator forming a face mask to be worn upon the face of a user for providing filtering of impurities in the air, including, means including at least a layer of filter material including outer peripheral edges formed generally to conform to the contours of the face of the user and providing for the passage of air through the layer of filter material and the filtering of the impurities of such air, the layer of filter material having an opening at a central position, an exhalation valve extending through the opening in the filter material for producing an exhaust through the valve of air exhaled by the user and including an inside surface within the central opening, and a non-porous flexible inner flange having peripheral edges forming a flexible half-mask, said peripheral edges conforming to the contours of the face of the user and disposed against the face of the user means to seal against leakage of the air inhaled by the user that passes through the filter material and to deflect such inhaled air after passage through the layer of the filter material, said means comprising said inner flange being sealed at its peripheral edges with the outer peripheral edges of the layer of filter material, means forming an inhalation passage between the inside surface of the exhalation valve and the surrounding portion of the central opening of the inner flange and passing, to the user, the inhaled air deflected by the inner flange and further constructed to abut the inside surface of the exhalation valve during the exhalation of air by the user to provide for the exhalation of air through the exhalation valve, said means forming an inhalation passage comprising the inner flange having an opening at a position corresponding to the opening in the layer of the filter material and extending inwardly to the central position, the inner flange having a portion surrounding the central opening in the filter material at a position conforming and contiguous to the inside surface of the exhalation valve and constructed to become spaced from the inside surface of the exhalation valve, upon the inhalation of air by the user.

16. The filter respirator of claim 15 wherein the inside surface of the exhalation valve and the surrounding portion of the inner flange form an inhalation valve.

17. The filter respirator of claim 16 additionally including a ring portion in the surrounding portion of the inner flange to enhance the flexibility of the surrounding portion of the inner flange.

18. The filter respirator of claim 15 wherein the layer of filter material includes integral outwardly extending flanges forming support surfaces for straps.

19. The filter respirator of claim 15, including, means on the inner flange for facilitating the sealing of the peripheral edges of the inner flange with the peripheral edges of the layer of the filter material, and means on the inner flange for conforming the contour of the inner flange to the contour of the face of the user.

20. The filter respirator of claim 15 wherein the exhalation valve includes an outer wall member forming an outside channel for the exhaled air so that the channel can be covered to block the flow of exhaled air to thereby check the seal of the inner flange to the face of the user.

21. The filter respirator of claim 15 wherein the inside surface of the exhalation valve is substantially flat and with the surrounding portion of the central opening of the inner flange also flattened.

22. The filter respirator of claim 15 wherein the inner flange includes puffed out portions to enhance the sealing of the inner flange to faces of users with different contours.

23. The filter respirator of claim 22 wherein the puffed out portions are at least in the areas corresponding to the sides of the nose.

24. The filter respirator of claim 22 wherein the puffed out portion are at least in the areas corresponding to the cheeks.

25. The filter respirator of claim 24 wherein the puffed out portions in the areas corresponding to the cheeks extend outwardly to form a sealing periphery for the inner flange and the inner flange is recessed in at least the nose bridge areas.

26. The filter respirator of claim 15 wherein at least the layer of filter material and the inner flange include an outer periphery with a flat profile and wherein the inner flange includes puffed out portions in the area corresponding to the cheeks to extend outwardly to form a sealing periphery for the inner flange and the sealing flange is effectively recessed in at least the nose bridge areas.

27. The filter respirator of claim 15 additionally including a plurality of integrally molded elongated air channels in the inner flange, the elongated air channels extending toward the central position and away from the layer of filter material.

* * * * *